United States Patent [19]

Foster et al.

[11] 3,992,751

[45] Nov. 23, 1976

[54] SPRING SASH COUNTERBALANCE

[76] Inventors: Edwin E. Foster, 1801 Camp Craft Road; Thomas E. Foster, 1800 Loop West 360, both of Austin, Tex. 78746

[22] Filed: June 23, 1975

[21] Appl. No.: 589,054

[52] U.S. Cl. ..... 16/197; 49/445

[51] Int. Cl.[2] ..... E05D 13/12; E05D 17/00

[58] Field of Search ..... 16/197, 211; 49/445, 49/446

[56] References Cited

UNITED STATES PATENTS

| | | | |
|---|---|---|---|
| 2,262,990 | 11/1941 | Cross et al. | 16/197 |
| 2,635,282 | 4/1953 | Trammell, Sr. et al. | 16/197 |
| 2,684,499 | 7/1954 | Lewis | 16/197 |
| 3,820,193 | 6/1974 | Foster | 16/197 |

*Primary Examiner*—Werner H. Schroeder
*Assistant Examiner*—Conrad L. Berman
*Attorney, Agent, or Firm*—Ralph W. Kalish

[57] ABSTRACT

A counterbalance for a window sash which comprises a bracket for securement to the window frame and which bracket contains spaced-apart slide plates with at least a pair of vertically spaced-apart transverse elements extending therebetween; there being a self-coiling spring suspended from each transverse member by means of the free end of such coil being lead over said transverse member. The free ends of said coil springs are connected to each other and then secured to a movable window sash for effectively counterbalancing same during movement between open and closed condition. Said transverse elements permit of at least two-point contact with said spring free ends whereby rocking of the spring coils is inhibited during sash counterbalancing operation.

3 Claims, 5 Drawing Figures

SPRING SASH COUNTERBALANCE

BACKGROUND AND SUMMARY OF THE INVENTION

This invention relates in general to window construction and, more particularly, to spring sash counterbalances therefor.

It is an object of the present invention to provide a spring sash counterbalance incorporating at least a pair of self-coiling springs which are interengaged to provide maximum counterbalancing strength within minimal space thereby obviating the customary resort to relatively large, heavy, wide coil springs which have proved unwieldy and unsatisfactory in operation.

It is another object of the present invention to provide a spring sash counterbalance of the type stated which embodies a novel bracket for maintaining at least a pair of self-coiling springs in vertically spaced-apart relationship to present a compact unit mountable upon a window frame in relative obscurity so as to minimize any detraction in the aesthetic appearance of the window.

It is a further object of the present invention to provide a spring sash counterbalance of the multiple spring type wherein the springs are suspended by means of transverse elements extending between opposed wall portions of a mounting bracket and with the free ends of said springs extending over said transverse elements and being in contact therewith in a manner to inhibit rocking of the suspended coils during movement of the connected sash between closed and opened conditions.

It is a further object of the present invention to provide a spring sash counterbalance which is extremely versatile in usage, being adapted for accommodating the demands of existing structure, that is, for example, from the standpoint of sash weight, window thickness, and length of stroke or travel required.

It is another object of the present invention to provide a spring sash counterbalance of the character stated which may be cheaply manufactured, being amenable to high volume, lost cost production; which may be quickly and securely engaged upon existing window constructions; and which is resistant to usage and, hence, being extremely durable; and which does not necessitate modification of existing structure in use.

DESCRIPTION OF THE PREFERRED EMBODIMENT

Figure 1:
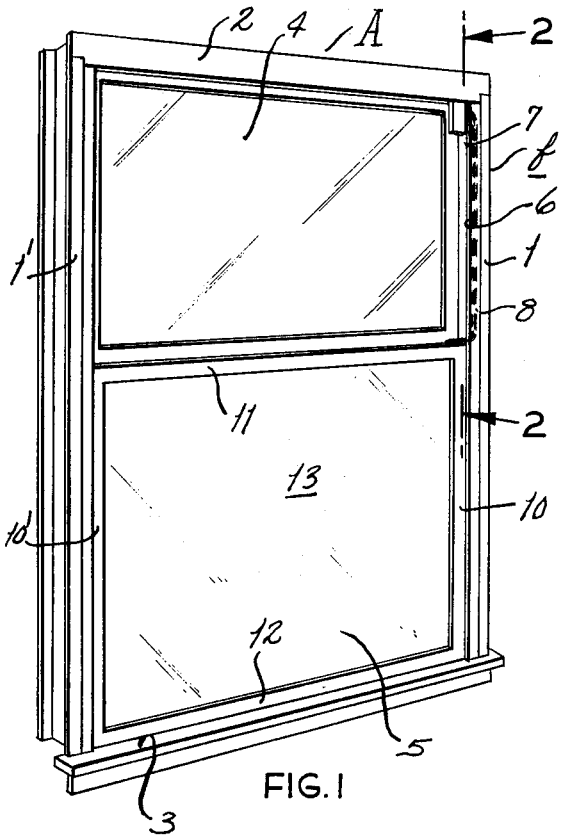
FIG. 1 is a perspective view of a window provided with a spring sash counterbalance constructed in accordance with and embodying the present invention.
Figure 2:
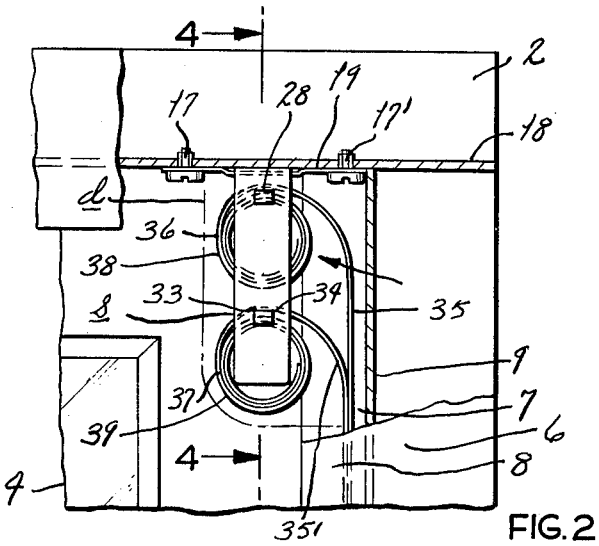
FIG. 2 is a fragmentary vertical sectional view taken on the line 2—2 of FIG. 1.

Referring now by reference characters to the drawings which illustrate the preferred embodiment of the present invention, A generally designates a window which may be made of any suitable material, such as wood, aluminum, or the like and which comprises a window frame *f* having side jambs 1,1', a header 2, and a sill 3; there being carried in said frame upper and lower sashes 4,5, respectively. For purposes of illustration, lower sash 5 is adapted for vertical reciprocal slidable movement, and upper sash 4 is shown as being stationary. For illustration only, window A is disclosed as of customary character but as will be evident below, the present invention is useful with other types of windows, such as those adapted for swingable movement of the upper and/or lower sash for cleaning, repair, and like purposes.

Each side jamb 1,1' incorporates a slide or guideway 6, being of channel shape and having rearward and forward flanges 7, 8, respectively, and an intervening web 9; said jamb channels opening inwardly or toward each other.

Lower window sash 5 comprises vertically presented parallel side components 10,10' and upper and lower transverse members 11,12, respectively, which elements coact in the usual manner for supporting a glass pane 13. Each side component 10,10' is of channel shape in cross section in its outer lateral portions having front and back flanges 14,15, respectively, and a web 16 therebetween, said channels opening outwardly toward the slide or guideway 6 of the proximate jamb 1,1', as the case may be, and with said flanges 14,15 being receivable within the same for travel of sash therein between upper, opened, and lower, closed condition.

Figure 5:
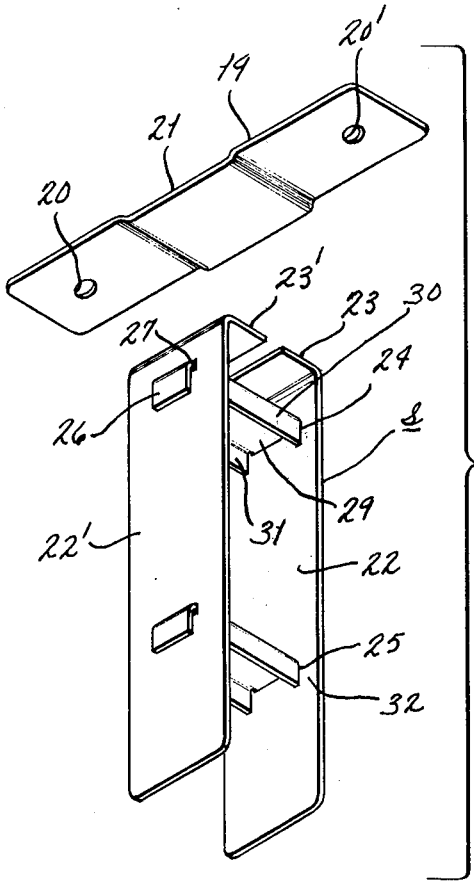
FIG. 5 is an exploded perspective view of the mounting bracket.
Figure 4:
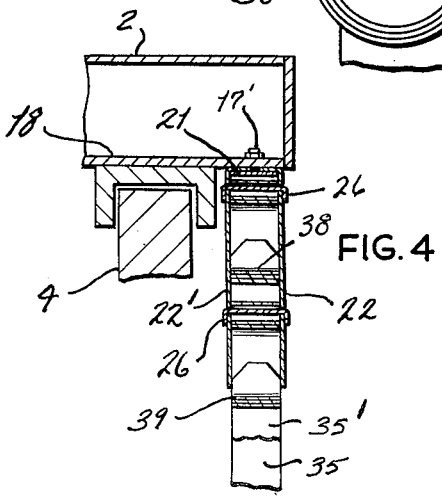
FIG. 4 is a vertical transverse sectional view taken on the line 4—4 of FIG. 2.

Secured as by screws 17,17', or like fasteners, to the under or downwardly directed face 18 of header 2 at each end thereof, immediately inwardly of, and proximate to, the adjacent jamb 1,1' and, hence, in the opposite upper corner portions of window A, are the ends of a narrow mounting plate 19; there being openings 20,20' in the opposite end portions of said plate for extension therethrough of said screws 17,17', respectively. The longitudinal axis of plate 19 is parallel to the corresponding axis of header 2 and in its central portion is depressed, as at 21, so that the upper surface thereof acts as a suspension for a depending spring mounting *s*; said latter being comprised of a pair of planarwise parallel spaced-apart, relatively elongated side walls 22,22' which at their lower ends are free, and at their upper ends are continuous with flanges 23,23', the under faces of which are supported upon the upper surface of plate central portion 21. Flanges 23, 23' are planarwise normal to the related side walls 22,22', respectively. It is to be understood, however, that if desired, spring mounting *s* could be made integrally by appropriate bending of a section of plate material to define side walls which are interconnected by a continuous top wall (not shown) as opposed to the cooperation of identical components, as shown in FIG. 5. Thus, each side wall 22,22', together with the associated flange 23,23', respectively, are of like construction and readily amenable to high volume production with there admittedly being no "rights" or "lefts".

Extending between side walls 22,22' is a pair of vertically spaced-apart transverse upper and lower elements 24,25, respectively, which may be of downwardly opening channel formation for rigidifying purposes and having at their opposed ends tabs, as at 26, for projection through apertures 27 formed in said side walls 22,22' and with the said tabs 26, as projected, being turned downwardly for integration of the side walls 22,22' and the elements 24,25 into a unified, stable mounting *s*. It will thus be seen that the upper surface 28 of the web 29 of each element 24,25 is planar and being substantially planarwise perpendicular to side walls 22,22'. Each web 29 is continuous along its side margins with downturned flanges 30,31 which are located spacedly inwardly of the proximate vertical margin of the adjacent side plate 22,22' to present a spacing, as at 32. It will thus be observed that by reason of the configuration of elements 24,25 the same will present remote and proximate edge portions 33,34 with respect to the nearest jamb 1,1'.

Lead over the upwardly directed surface 28 of webs 29 of each element 24,25 is the outer or free end 35,35' of the coil 36,37, respectively, of spring counterbalances 38,39, respectively; said springs being of the self-coiling type, being fabricated of suitable ribbon stock and which may be of the character of spring set forth in U.S. Pat. No. 2,609,191. It is to be observed that the said spring coils 38,39 are of a transverse extent or width commensurate with the distance between side walls 22,22' of support *s* so that shifting of the same longitudinally of the associated elements 24,25 is inhibited, but with such relationship not impeding the coiling and uncoiling action of said springs 38,39. It will be seen that the spatial relationship between transverse elements 24,25 is adequate to prevent interference between said springs 38,39 during coiling and uncoiling action and with said upper transverse member 24 being located sufficiently downwardly of the under face of the central portion 21 of mounting plate 19 so that the free end 35 of said coil 36 may move freely between same and the upper surface of said transverse support 24.

Transverse elements 24,25 thus, in effect, serve as hangers for the associated springs 38,39 as the major portion of the coils thereof will depend below said elements by reason of the engagement of the free ends 35,35' thereof being in snug contact with elements 24,25 through the inherent urging or tendency of said springs 38,39 to coil upon themselves.

Figure 3:
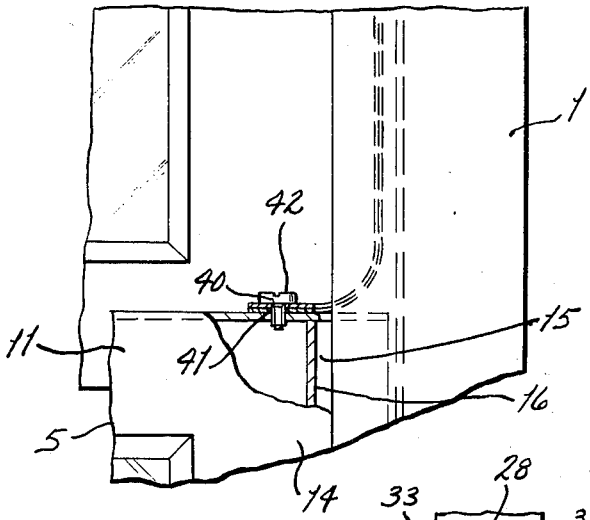
FIG. 3 is an enlarged view, in partial section, taken at the arrow in FIG. 2.
Figure 3:
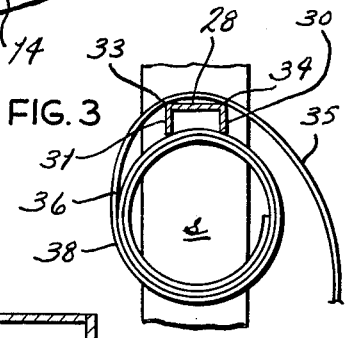

With special reference being made to FIG. 3, it will be seen that the portions of said springs 38,39 extending over the related elements 24,25 will actually engage the latter at edge portions 33,34 providing what might be considered a double line contact which, as will be shown, serves to balance the related springs 38,39 against rocking movement about such elements 24,25.

As may be best seen in FIG. 3, the free ends 35,35' of springs 38,39 are directed downwardly within slide or guideway 6 of the adjacent jamb 1,1', as the case may be, and with the outer surface of the free end of coil 35' being brought into substantially abutting relationship with the confronting surface of the free end portion 35 of spring 38, each of which at their free end extremities is provided with an opening, as at 40,41 for receiving a screw or like fastener 42 for the purpose of uniting said coil free ends into a single spring arm of what might be considered double strength and with such screw 42 serving to engage said free end extremities upon the upwardly directed surface of the upper transverse member 11 of lower sash 5; said point of securement being, preferably, located slightly laterally inwardly of the outer portion of sash 5, as in substantial vertical alignment with the superimposed coils 36,37 of springs 38,39.

From the foregoing it will thus be readily observed that the present invention permits of the utilization of a counterbalance of preselected, but considerable, force for accommodating sashes of substantial weight, while accomplishing same in a most compact fashion. If a single spring were to be utilized, it would necessarily have to be of substantial diameter when coiled and thus could easily demand undesired spatial accommodation. With the present invention, a pair of springs each having relatively reduced diameters are used, and being in vertical relationship within a relatively reduced volume and yet are productive of the requisite counterbalancing force as may be required throughout a considerable range of sash weights. Admittedly, the use of the pair of springs of the present invention will permit of a desired narrowness of the coil stock so that the interengaged free ends may move freely within slide or guide-ways of relative narrowness and thus obviate any requirements for modification of the window frames. By the present invention, a most remarkable range of spring stock thickness may be availed of so as to present the requisite force, but without alterations in the brackets *s* or the window construction.

As pointed out above, an important feature of the present invention is the particular relationship of the free end of each spring 38,39 with respect to the transverse elements since the double-line contact, as pointed out above, effectively inhibits any rolling or angular movement of the respective spring coils 36,37 during sash raising and lowering so that a housing or dustbox of minimal volume, as suggested at *d*, is adequate for encompassing the mounting *s* and the associated springs 38,39. Also it may be pointed out that the mutual reinforcing brought about by the interengagement of the free ends of springs 38,39 assures of a wide range of travel or stroke, while assuring of constant force throughout the same.

It is, of course, apparent from the foregoing that it would be within the scope of the present invention to utilize more than two springs concurrently but experience has demonstrated that a pair of appropriately selected springs will meet the wide range of extant window requirements.

Although a simple dust cover may be utilized, it is to be appreciated that the relatively forceful friction-producing engagement between the free ends 35,35' of springs 38,39 of transverse elements 24,25 will bring about a rubbing action serving to displace any dirt, grease, or the like which may have inadvertently adhered to the spring during usage.

Although the present invention has been illustrated as being suspended from the window header, it is, of course, obvious that, if requirements are such, the mounting bracket *s* could be inverted for disposition upon a lower portion of the window or upon the lower sash or frame should it be utilized for counterbalancing a movable top sash.

Having described our invention, what we claim and desire to obtain by Letters Patent is:

1. For use with a window having a frame incorporating side jambs, a header, and a sill and a sash mounted within said frame for reciprocal slideable movement therein toward and away from said header, said sash incorporating an upper portion, a counterbalance for said sash disposed within said frame and comprising at least two self-coiling springs of ribbon character arranged in vertically aligned relationship, each spring having a supply coil portion and an outer, normally free end directed toward the proximate jamb, means interengaging the outer ends of said springs in the extreme portions thereof and securing same to the upper portion of said sash, a support element affixed to said frame header, said element comprising vertically spaced apart transverse components having webs with spaced apart jamb-adjacent and jamb-remote edges, said outer end portions of each spring being directed over the associated transverse component for free suspension of the related supply coil therebelow, the radius of curvature of the convolutions of each spring coil being such that the end portion thereof led over the related transverse component engages the related web only on its said edges thereby developing spaced apart lines of contact whereby the respective suspended supply coils are restrained against rocking during coiling and uncoiling action responsive to movement of said sash.

2. The invention defined in claim 1 and further characterized by said support element comprising spaced apart side plates, said transverse components being fixed at their ends in said side plates, means mounting said side plates at their upper end portions for dependency from said header adjacent the proximate jamb, the distance between transverse components being slightly greater than the diameter of the supply coil of said springs.

3. The invention defined in claim 2 and further characterized by each of said transverse components having planar parallel flanges depending from the web edges.

* * * * *